US010483707B2

(12) United States Patent
Torres et al.

(10) Patent No.: US 10,483,707 B2
(45) Date of Patent: Nov. 19, 2019

(54) PLUGGABLE MODULE WITH COAXIAL CONNECTOR INTERFACE

(71) Applicant: METHODE ELECTRONICS, INC., Chicago, IL (US)

(72) Inventors: Luis Torres, Schaumburg, IL (US); Joseph Llorens, Winfield, IL (US); Alexandros Pirillis, Skokie, IL (US); Robert Skepnek, Norridge, IL (US)

(73) Assignee: Methode Electronics, Inc., Chicago, IL (US)

( * ) Notice: Subject to any disclaimer, the term of this patent is extended or adjusted under 35 U.S.C. 154(b) by 0 days.

(21) Appl. No.: 15/701,310

(22) Filed: Sep. 11, 2017

(65) Prior Publication Data

US 2018/0076588 A1 Mar. 15, 2018

Related U.S. Application Data

(60) Provisional application No. 62/385,765, filed on Sep. 9, 2016.

(51) Int. Cl.

| | |
|---|---|
| ***H01R 13/66*** | (2006.01) |
| ***H01R 31/06*** | (2006.01) |
| ***H01R 13/46*** | (2006.01) |
| ***H01R 12/70*** | (2011.01) |
| ***H01R 24/54*** | (2011.01) |
| *H01R 101/00* | (2006.01) |

(52) U.S. Cl.

CPC ..... *H01R 31/065* (2013.01); *H01R 12/7076* (2013.01); *H01R 13/46* (2013.01); *H01R 24/542* (2013.01); *H01R 2101/00* (2013.01); *H01R 2201/04* (2013.01)

(58) Field of Classification Search

CPC .. H01R 31/065; H01R 13/46; H01R 12/7076; H01R 13/6275

USPC ..... 439/76.1, 620.03, 607.23, 350, 352; 361/728

See application file for complete search history.

(56) References Cited

U.S. PATENT DOCUMENTS

| | | | | |
|---|---|---|---|---|
| 5,599,190 | A * | 2/1997 | Willette | H01R 13/518 439/43 |
| 5,639,262 | A * | 6/1997 | Lim | H01R 31/06 439/607.38 |
| 5,923,237 | A * | 7/1999 | Sato | H03H 7/42 336/192 |
| 6,350,063 | B1 | 2/2002 | Gilliland et al. | |
| 6,434,015 | B1 | 8/2002 | Hwang | |
| 6,848,943 | B2 * | 2/2005 | Machado | H01R 13/6658 439/607.01 |
| 6,884,097 | B2 * | 4/2005 | Ice | G02B 6/4201 361/728 |

(Continued)

OTHER PUBLICATIONS

MoCA 2.0/2.5 Specification for Device RF Characteristics 20160808.

*Primary Examiner* — Hae Moon Hyeon
(74) *Attorney, Agent, or Firm* — Gould & Ratner LLP

(57) ABSTRACT

A pluggable module comprising a housing having a first end and second end, an edge connector disposed at the first end, an F-type coaxial connector at the second end and a release lever including a stamped body that is symmetrical about a centerline bisecting the length of the body. The pluggable module comprises a miniature balun disposed within the module for converting between a single-ended input to a differential load.

21 Claims, 13 Drawing Sheets

(56) References Cited

U.S. PATENT DOCUMENTS 6,942,395 B1 9/2005 Chuan et al.
7,181,173 B1 2/2007 Daly
7,215,554 B2 * 5/2007 Torres ..... H01R 13/6582 361/747
7,351,090 B1 * 4/2008 Moore ..... G02B 6/4246 439/372
7,637,672 B1 12/2009 Li et al.
8,002,575 B2 8/2011 Li
8,040,687 B2 10/2011 Pirillis
8,052,335 B2 11/2011 Kasbeer-Betty
8,335,088 B2 12/2012 Pirillis
8,523,595 B2 9/2013 Wu
9,071,229 B1 * 6/2015 Ji ..... H03H 7/42
9,472,898 B2 10/2016 Yang
2005/0041407 A1 * 2/2005 Torres ..... H01R 13/6582 361/797
2005/0259994 A1 11/2005 Zhang
2007/0283406 A1 * 12/2007 Blake ..... H01R 24/547 725/127
2009/0227133 A1 9/2009 Zhang
2010/0115316 A1 5/2010 Diab
2010/0295646 A1 * 11/2010 Harrison ..... H01F 19/04 336/192
2011/0081807 A1 4/2011 Rephaeli
2011/0164382 A1 7/2011 Pirillis
2011/0287642 A1 11/2011 Wang
2012/0052712 A1 3/2012 Wang
2013/0217256 A1 * 8/2013 Dudemaine ..... H01R 13/46 439/352
2013/0273766 A1 10/2013 Lindkamp
2014/0179143 A1 6/2014 Kappla
2015/0031246 A1 1/2015 Wu
2015/0111402 A1 4/2015 Hackman
2015/0162709 A1 * 6/2015 Shen ..... H01R 13/6272 439/352
2016/0241293 A1 8/2016 Huang et al.
2016/0336685 A1 11/2016 Phillips
2018/0076588 A1 3/2018 Torres

* cited by examiner

PLUGGABLE MODULE WITH COAXIAL CONNECTOR INTERFACE

The present invention claims priority to Provisional application No. 62/385,765 filed Sep. 9, 2016, which is incorporated herein by reference.

The present application pertains to the field of high speed communications and in particular, a pluggable module having a coaxial connector interface.

BACKGROUND

Telecommunications service providers, or carriers, today are focused on the delivery of broadband and ultra-broadband Internet services (or broadband) consisting of video, data and voice; not just telephony as their main source of revenue. The term broadband refers to wide bandwidth data transmission with the ability to simultaneously transport multiple signals and traffic types, sometimes referred to as converged data, over various media types. In the context of Internet access, broadband is used to mean any high-speed Internet access that is always available, in other words always on, and faster than traditional dial-up access. Broadband services can be delivered by one of four means: Digital Subscriber Line (DSL), Cable, Optical Fiber and Satellite.

Telecommunications carriers prefer to deliver their broadband services using DSL because it re-uses the twisted pair phone lines already running out to every residence and business. They are exploring the use of fiber because of its superior bandwidth and speed but the cost to run fiber to the residence or business in anything other than a so called 'green field', new construction situation remains prohibitively high. DSL has evolved gradually over the last 20-years since being first deployed but has consistently been outpaced in terms of bandwidth and speed by broadband services delivered over cable. Today, however, new technologies, including Gfast and G/now/G.hn, are emerging that are able to deliver gigabit broadband services over telephony twisted pair thus giving telecommunications carriers a solution that is competitive with cable and even optical fiber. These new ultra-fast broadband technologies are emerging at a time when the need to minimize capital expense and increase revenue from existing copper assets is at an all time high for the telecommunications carriers. This pressure has forced some carriers to take on the cable assets of otherwise failing satellite services companies in an attempt to profitably monetize them. Now with a mix of both twisted pair and coaxial copper assets, some telecommunications carriers are in need of a convenient means for adapting between the different cable types for broadband delivery to the premises or business.

The invention proposed here address that need and solves the problem by integrating the media interface into a pluggable module suitable for any customer premise equipment (CPE) provisioned with a corresponding socket and cage. Pluggable modules that can be fitted to a CPE for broadband technologies, including Gfast, with a twisted pair electrical connector interface exist. What's missing is a complementing pluggable module with a connector interface suitable for connecting to the coaxial cable assets now owned by some telecommunications carriers.

SUMMARY

The invention integrates an F-Type connector into a pluggable transceiver module, including but not limited to a Small Form Factor Pluggable (SFP) module, to allow for native connectivity to 75Ω coaxial cable infrastructure. Additionally the invention integrates a balun (balancer/unbalance converter) inside the pluggable module to perform the 75Ω single-ended to 100Ω differential conversion necessary between the coax input and subsequent signal processing circuitry. In so doing the invention eliminates the need for an external balun when connecting coaxial cable to equipment ordinarily intended for a twisted pair, balanced connection.

Prior to this invention, in order to connect between coaxial cable and telephony twisted pair it was necessary to use an external balun such as the Gfast balun available from Comtest Networks. Such an external Balun adds incremental cost and complexity when interfacing between coaxial cable and equipment with a twisted pair interface. Additionally the use of an external balun is not an elegant solution because just a standard balun is as big, or indeed bigger, than a pluggable module, such as an SFP.

The invention eliminates the need for an external, oftentimes relatively bulky and expensive standard external Balun when interfacing between coaxial cabling and a telephony twisted pair interface. The invention is compact and by virtue of being integrated into a pluggable module, delivers better signal integrity and overall improved broadband performance. In order to accomplish the invention it was necessary to define, implement and test a miniature Balun of sufficient performance and miniature size that it could be integrated into the pluggable module. Likewise with the F-Type connector it was necessary to develop a host of proprietary hardware for integrating it with the housing of the pluggable module. Furthermore the invention is novel because in addition to the F-Type coaxial interface and an integrated Balun, the pluggable module also incorporates all the electronics necessary for a complete Gfast physical layer interface. As a pluggable module, the invention allows original equipment manufacturers (OEMs) to provision their solutions with a single receptacle port compatible with the invented pluggable module such that adapting between different media types is as straightforward as swapping the pluggable module for one with the needed media interface.

The present invention includes a pluggable module compliant with a Small Form Factor Pluggable (SFP) specification, wherein the balun omits at least one of the following elements: a) thru-hole leads; b) over-molding; and c) ferrite core of low magnetic permeability.

Also the balun may provide at least one of the following elements: a) surface mount leads; b) ferrite core of high magnetic permeability; c) an overall height of the balun package being restricted for use within the envelope dimensions provided by SFP specification.

The invention provides for a miniaturized SFP package by providing a printed circuit board (PCB) having components on both sides of the PCB and the balun having surface mount leads for mounting to pads on a first side of the PCB and facilitating mounting of other components on a second side of the PCB. The invention may comprise a release lever including a stamped body that is symmetrical about a centerline bisecting the length of the body. The invention wherein the release lever body is stamped from a flat metallic sheet. Also the body may include three segments, the first segment forming a generally "H" shaped release member, an opposite second segment having side serrations for receiving a button thereon and a third segment disposed between the first and second segments, the third segment having an opening and a tab extending into a bottom portion of the "H" shaped member.

The invention may comprise a module having an enlarged end having a lever mating area including a finger disposed within the opening; a resilient member for receiving the tab thereon and a pair of legs of the "H" shaped portion for sliding and engaging a release tab. wherein the housing is cast from aluminum, aluminum alloy, zinc or zinc alloy. The invention may further comprise a Gfast wireline physical layer, G.Now/G.hn wireline physical layer or VDSL/VDSL2 wireline physical layer.

A further embodiment of the invention provides a pluggable module comprising a housing having a first end and second end, an edge connector disposed at the first end, an F-type coaxial connector at the second end and a release lever including a stamped body that is symmetrical about a centerline bisecting the length of the body wherein the body is stamped from a flat metallic sheet. Also the body may include three segments, the first segment forming a general "H" shaped release member, an opposite second segment having side serrations for receiving a button thereon and a third segment disposed between the first and second segments, the third segment having an opening and a tab extending into a bottom portion of the "H" shaped position.

The invention further comprises a module having an enlarged end having a lever mating area including a finger disposed within the opening, a resilient member for receiving the tab thereon and a pair of legs of the "H" shaped portion for sliding and engaging a release tab. The invention may further comprise a miniature balun disposed within the module for converting between a single-ended input to a differential load.

A further embodiment of the invention provides for a method of assembling a pluggable module comprising the steps of obtaining a balun having a ferrite core having high magnetic permeability, mounting the balun to a first side of a printed circuit board (PCB) via a surface mount process, mounting other components to a second side of the PCB, casting a housing from aluminum, aluminum alloy, zinc or zinc alloy stamping a release lever from a flat sheet of metal, and forming the release lever by bending the flat metal to form a first, second and third segment of the release lever.

Also the body of the release lever may be formed to provide, the first segment forming a generally "H" shaped release member, an opposite second segment having side serrations for receiving a button thereon and the third segment disposed between the first and second segments, the third segment having an opening capable of receiving a tab extending into a bottom portion of the "H" shaped member.

DETAILED DESCRIPTION

Embodiments of the Coaxial Module invention are depicted in FIGS. 1-15. In particular, a module having an edge connector at the first end that is compliant with SFP standard SFF—8431 SFP+ specification. The module may have connectors, latching mechanisms and other components, as disclosed in U.S. Pat. Nos. 7,181,173; 8,040,687 and 8,335,088 that are incorporated herein by reference. The second end of the module includes an F-Type coaxial connector as shown in FIGS. 1-5. Such a module is pluggable into a receptacle of a host device, for example, Customer Premise Equipment.

Figure 1:
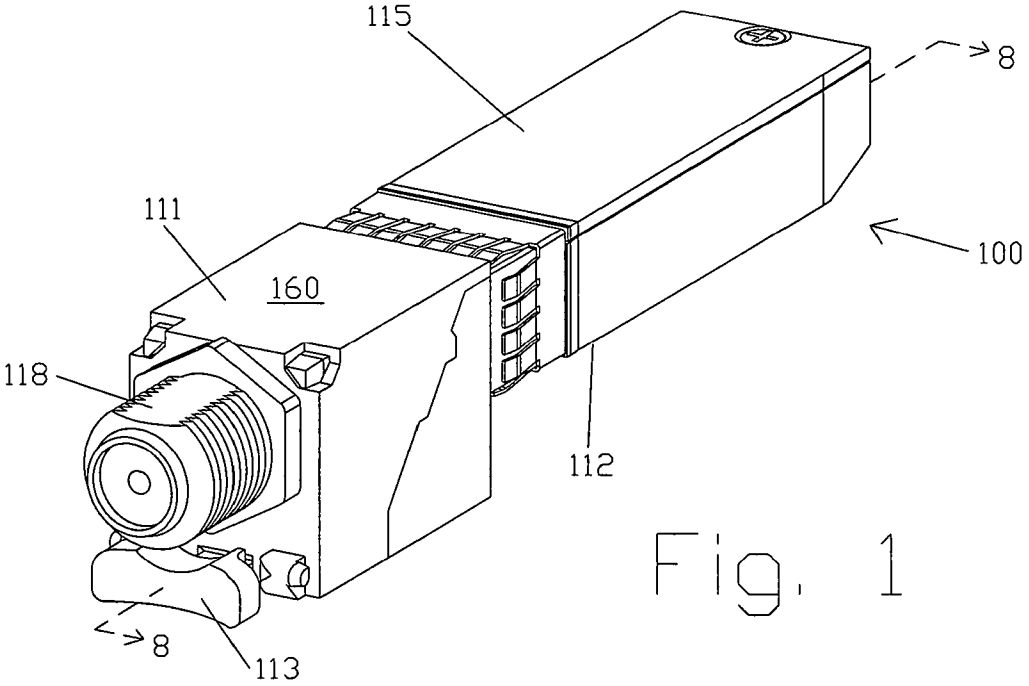
FIG. 1 is a perspective view of a module of the present invention.

Turning to FIG. 1 the pluggable module 100 is depicted in an embodiment having a housing top 111, a housing bottom 112 and a disengager button 113. In an embodiment the housing is compliant SFP and SFP+ specifications, so that front body housing 115 may be inserted into a cage of a host device (not shown) and electric connection is accomplished by an edge connector 132 mating with a corresponding connector on the mother board of the host device (not shown). In an embodiment, the host device may be a router, switcher, hub, blade, cable box, distribution point unit or other data or telecom equipment.

Figure 2:
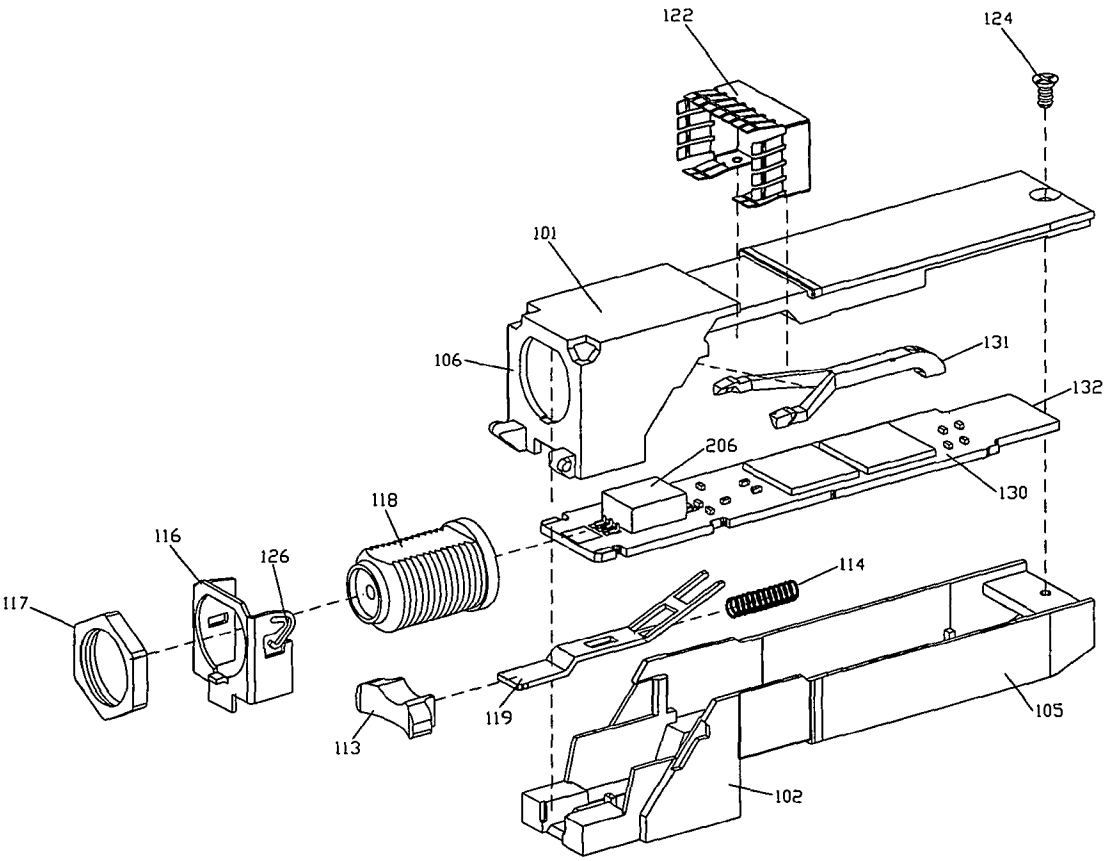
FIG. 2 is an exploded view of the module of FIG. 1.

Turning to FIG. 2 a flange 116 is provided in combination with nut 117 to secure an F-Type coaxial connector to a printed circuit board (PCB) 130. The flange 116 is stamped and formed with a resilient clip 126 that provides a compression contact against a solder pad of PCB 130. The pad, in an embodiment is connected to ground so that the flange 116 is grounded to facilitate Electro-Magnetic Interference (EMI) shielding for the module 100.

In an embodiment the module 100 includes a release lever 119,120. In first embodiment, the release lever (FIGS. 1 and 2) is a push style lever that allows a user to push button 113 in order to cause the module 100 to "pop" out of the host device a first distance from the host face plate (not shown). Once the module 100 is ejected to the first distance, there is room for the user to grab the sides of the module housing 101 (top half),102 (bottom half) with his/her fingers in order to remove the module 100 the remaining distance, so that the entire module may be removed from a cage of a host device (in order to repair the module 100 or to upgrade of downgrade the host device with a new module having alternate functionality (e.g. copper to fiber)). Further description of the release lever 119 is provided with respect to FIGS. 8-14 below.

Figures 4, 5:
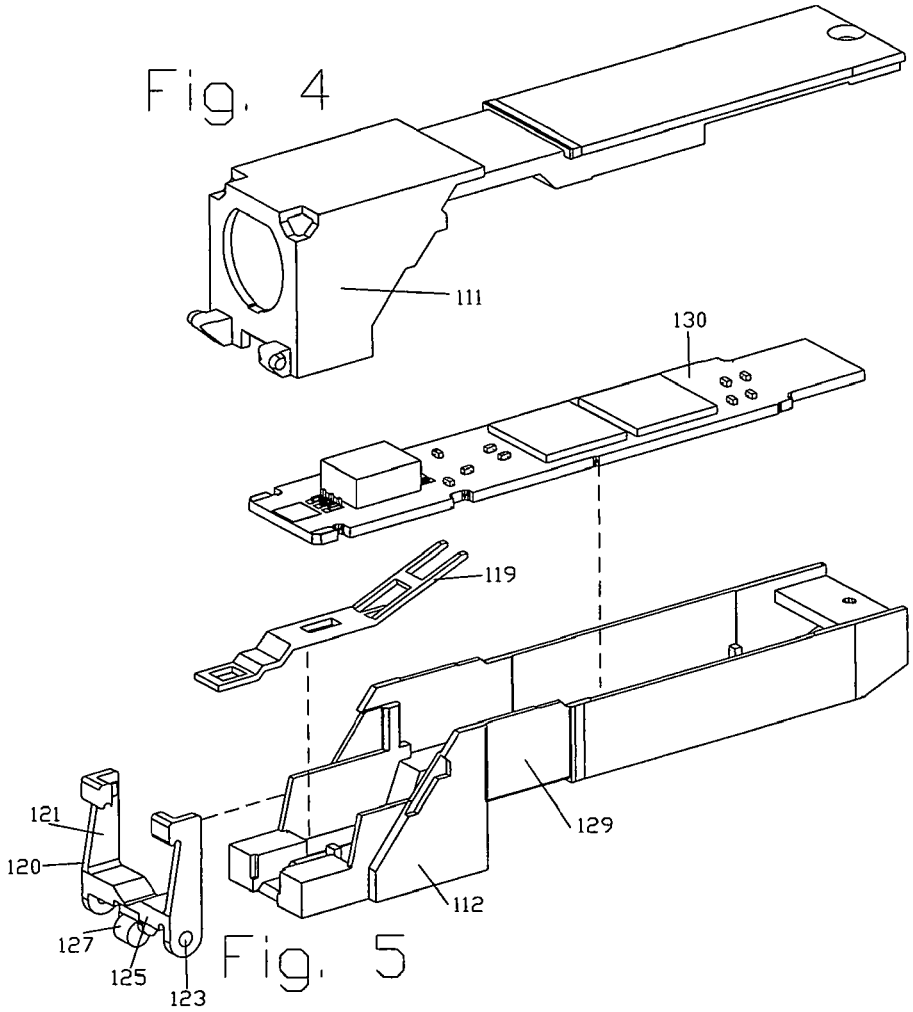
FIG. 4-5 is an exploded perspective view of the module of FIG. 3.

FIG. 2 also depicts EMI collar 122 to be clipped onto housing 101 (top half) of the module 100 within recess 129 (FIG. 5). The collar 122 includes fingers for engaging a face plate of a host device to ground the collar 122 to the host (not shown). In an embodiment the housing 100 is metallic, such as zinc alloy, zinc, aluminum or aluminum alloy, so that the collar 122 may ground to the housing 101 (top half), 102 (bottom half) to provide EMI shielding for the module 100. A fastener 124 attaches the top half of the housing 101 (top half) to the bottom housing 102 (bottom half) with the PCB 130 disposed between. Y-spacer 131 is mounted within upper half 101.

Figure 3:
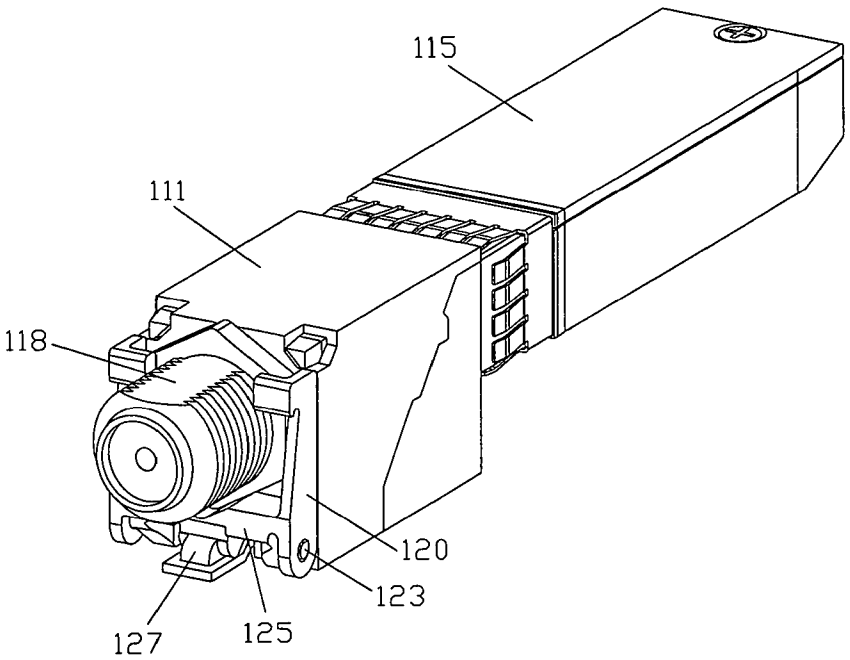
FIG. 3 is perspective view of an alternate embodiment of a module of the present invention.

Turning to FIG. 3, an alternative release lever 120 is depicted. In an embodiment, the lever provides a pivoting motion about axle 123 when a user grabs lever arm(s) 121 and pulls downward (from the position depicted in FIGS. 3 and 5) to activate release latch 127 so that the module is released from the host and the user, by continuing to rotate the lever arms 121, causes the arms to pivot around base bar 125 and axle 123, so that the release lever 120 moves to a second/horizontal orientation and continued pulling by the user will allow for complete removal of the module first end 105 (opposite second end 106) from the host. As depicted in FIG. 5, the lower housing 112 may have pivoting release lever 120, and also release lever 119 to accommodate rapid conversion of the module 100 from one version of the release lever to the next.

Figure 6:
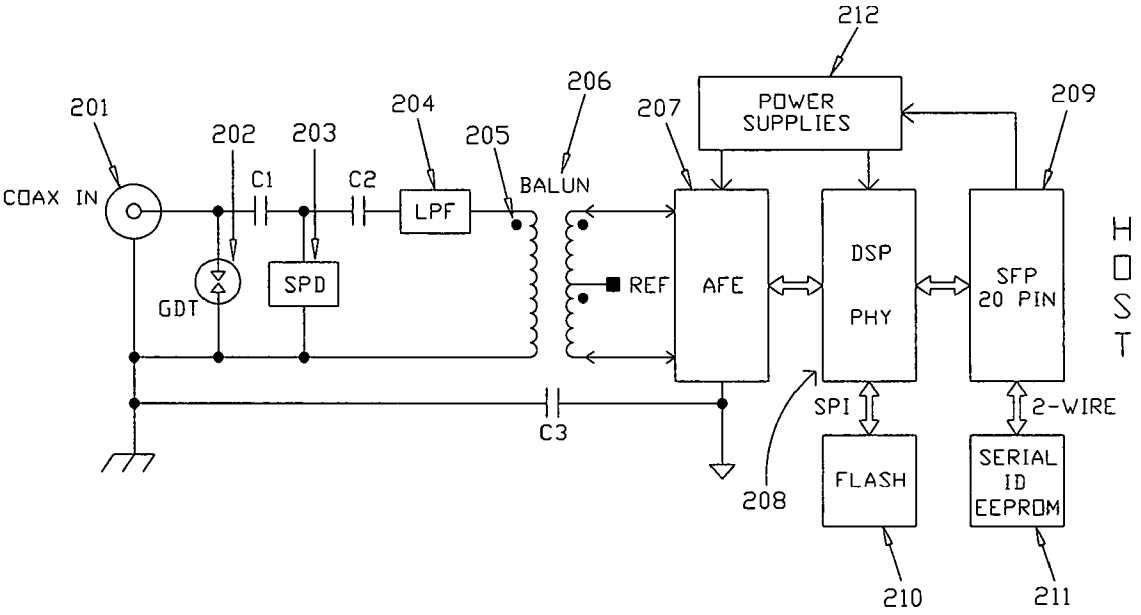
FIG. 6 is a block diagram of the electronics of the module.

FIG. 6 depicts an electronic diagram of an embodiment of the present invention. The module PCB 130 has circuitry and components including input via F-type connector input 201, a gas discharge tube (GDT) 202, a surge protection device (SPD) 203, a low pass filter (LPF) 204, and a balun chip 206 having a package including at least one surface mount contact 205. Chipsets are also provided on the PCB 130 for an analog front end (AFE) 207, a digital signal processor (DSP) core providing a Gfast/G.now VDSL/VSDL2 PHYSICAL (PHY) layer device 208, a 20 pin connector 209 compliant with an SFP or SFP+ specification (e.g. and edge connector), a memory device 210, such a FLASH chip, a serial ID EEPROM 211 and a power supply 212 (e.g. battery or DC supply).

Figure 7:
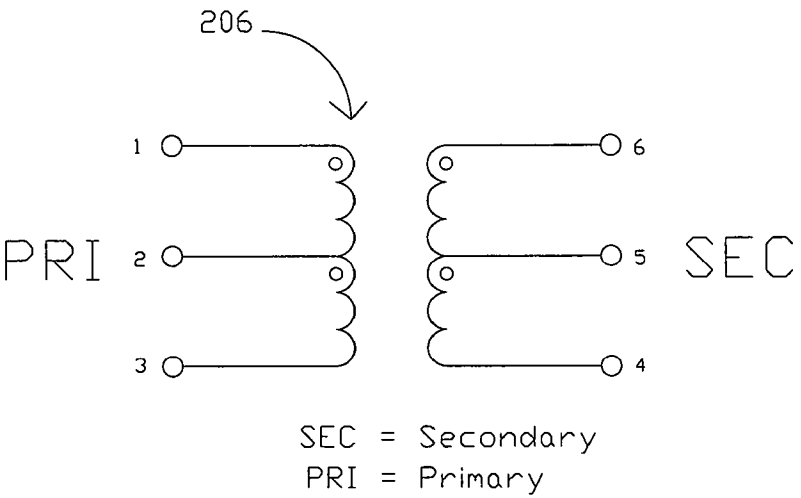
FIG. 7 is a block diagram of a balun of the module of the present invention.

FIG. 7 depicts balun chip 206 having through hold leads 1-3 on Primary (PRI) side and through hold leads 4-6 on Secondary (SEC) side.

A more detailed description of the above components 201-212 follows:

Coaxial input 201 such as an F-Type connector is preferred for telecommunications carriers with RG-59, 75Ω coaxial cable assets but other connector types can be adapted to the invention. A coupling capacitor C1, serves as a DC-block to eliminate DC-bias oftentimes present on a coaxial cable used to feed a remote low noise amplifier (LNA) or low noise block (LNB), from entering the electronics contained within the pluggable module. Nonetheless, the implementation can be adapted to incorporate a power splitter in place of the coupling capacitor C1 for those situations where a DC voltage is present on the coaxial cable for the purpose of remotely powering the host device that the module is plugged into.

Gas Discharge Tube (GDT) 202 is a component designed to dissipate the energy associated with a high over-voltage transient and is applied in the invention to protect against over voltage associated with a lightning strike event. The technology associated with GDT 202 has evolved sufficiently that today it is possible to incorporate one as the basis for lightning over-voltage protection in a device as compact as an SFP module. This is vital for the invention which can be connected to telecommunications carrier copper infrastructure that extends outdoors where it is vulnerable to lightning strike events.

Surge protection device (SPD) 203 has an arrangement of a type Zener diode designed with a fast transient response time used to limit over-voltage surges most typically associated with lightning strike events. The SPD 203 is implemented in conjunction with a GDT 202 to deliver the over-voltage protection required by telecommunications carriers for any equipment connected to their copper cable infrastructure.

Low Pass Filter (LPF) 204 is a collection of passive elements, capacitors, inductors and resistors, arranged to filter high frequency noise that might otherwise prove troublesome to the proper function of the invention. The LPF 204 can optionally be implemented to mitigate the influence and associated cross-talk resulting from other signals co-existing on the coaxial cable such as cable television (CATV) signals.

Balun (balanced unbalanced transformer) 206 is an electrical device that converts between a balanced signal (two signals working against each other where ground is irrelevant) and an unbalanced signal (a single signal working against ground or pseudo-ground). A balun can take many forms and may include devices that also transform impedances. The balun 206 may also provide a transformer component for converting between a single-ended, or unbalanced, input to a differential, or balanced, load. In one embodiment, the balun serves to transform between single-ended 75Ω coaxial cable and a 100Ω differential interface to-from the analog front-end (AFE). The invention improves on this approach by integrating a Gfast or G.now/G.hn balun into a pluggable module along with a native F-Type interface as well as the rest of the circuitry needed to implement an entire Gfast or G.now/G.hn physical layer connection. The balun used in the present invention is miniaturized by omitting the over-molding typical and usual for a stand-alone, external balun. The over-molding in an embodiment is omitted by design as a custom component for use in the present invention. Omitting the Balun 206 over-molding reduces component height and width. The balun 206 used in the present module 100 is miniaturized (e.g has a low profile package) by replacing standard through-hole mounting leads with custom surface mount contacts 205. The surface mount contacts are a feature of the custom balun 206 used for the present invention (FIG. 7).

Figure 14:
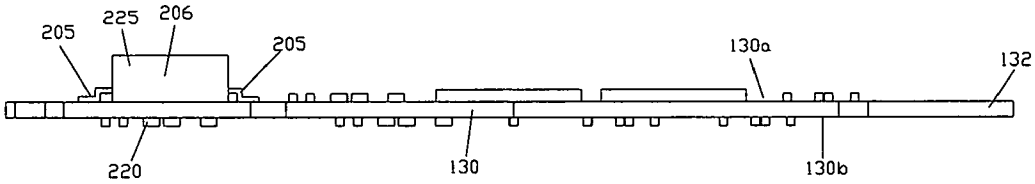
FIG. 14 is a side elevation view of a printed circuit board (PCB) of the present invention.
Figure 15:
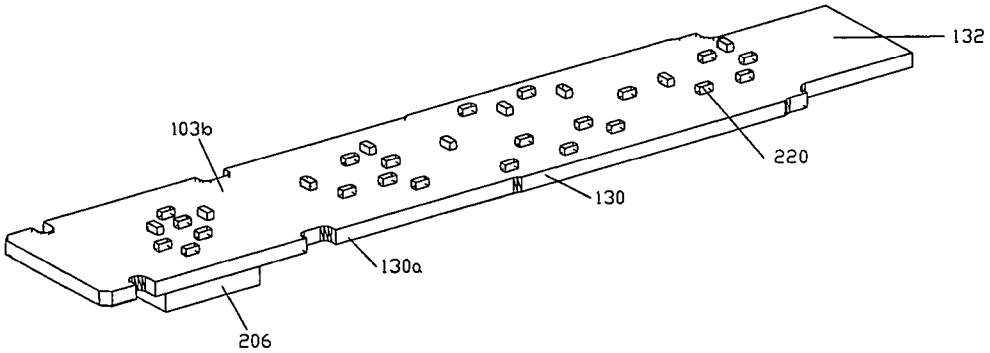
FIG. 15 is a perspective view of the bottom of the PCB of FIG. 14.

The incorporation of surface mount leads 205 for the balun 206 on a first/top side 130*a*, means that components 220 can be placed on the opposite/bottom side 130*b* of the printed circuit board 130 under the balun 206 (see FIG. 14-15).

Also providing a higher magnetic permeability for the balun 206 allows for a smaller ferrite core 225 and a smaller finished balun 206. The balun used in the module is miniaturized by selecting a ferrite core 225 with a high magnetic permeability. A larger, more typically sized balun uses lower cost, lower magnetic permeability ferrite cores.

Analog Front-End (AFE) 207 provides an integrated circuit interface circuit that resides between the balun 206 connected to the coaxial cable plant that carries complex modulated data and the digital core responsible for processing the demodulated baseband data. In the transmit direction, the AFE 207 is responsible for conditioning and amplifying the signal from the digital processing core for transmission through connected coaxial cable. In the receive direction the AFE is responsible for first normalizing the input signal amplitude then conditioning the complex modulated data inbound from the connected coaxial cable plant in order that it can be decoded by the digital processing core.

Digital Signal Processor/PHYSICAL layer device (DSP/PHY) 208 is an integrated circuit that resides between the AFE 207 and small form-factor pluggable (SFP) 20-pin host connector 209. The DSP/PHY 208 is responsible for adapting data between the host environment, typically Ethernet traffic in the form of a standard SGMII (serial gigabit media independent interface) The complex modulation format is necessary for transmission over the connected coaxial cable plant (via the AFE for signal conditioning and amplification) .

Small Form-factor Pluggable (SFP) 20-pin connector 209 in an embodiment is an edge of the SFP transceiver PCB that mates with the corresponding SFP electrical connector on the host, consistent with the recommended pattern layout and pin assignment described in the SFP multi-source agreement (INF-9074i).

Flash memory 210 is a non-volatile memory chip that holds the configuration settings and information for the AFE 207 and DFE Serial ID EEPROM 211 is a non-volatile memory chip providing the memory map for static and dynamic data defined in the multi-source agreement SFF-8472. The static serial identification (ID) provides the host information that describes the transceiver module's capabilities, standard interfaces, manufacturer and other related information. The dynamic data is intended to provide the host with real time access to a device operating parameters such as voltage and temperature.

Power Supplies 212 is a system of DC/DC switching power supplies that converts a fixed 3.3V input voltage to the various voltage rails required for proper operation by the AFE 207, DFE, flash 210 and serial ID EEPROM 211.

Turning to FIGS. 8-13, an alternate embodiment of the release lever 119 will be described. The lever 119 is slidingly mounted into lower housing half 102 so that the lever body 150 includes three segments, the first segment 151 forming a generally "H" shaped release member 150, an opposite second segment 152 having side serrations 156 for receiving a button 113 thereon and a third segment 153 disposed between the first 151 and second segments 152, the third segment 153 having an opening 157 and a tab 158 extending into a bottom portion of the "H" shaped member 151.

Figure 8:
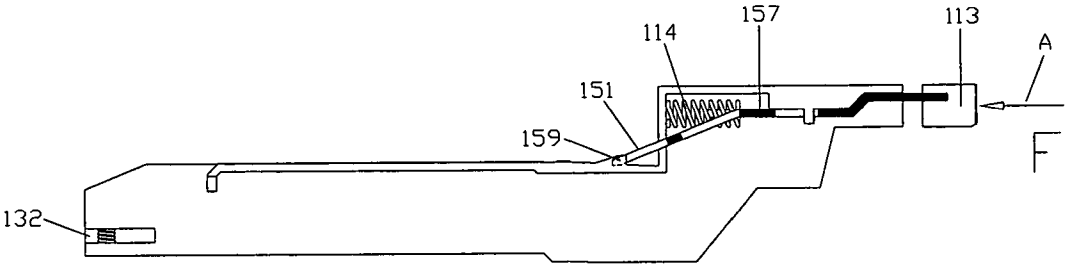
FIG. 8 is a side elevation cut-away view taken at line 8-8 from FIG. 1 depicting the push button in a first position.
Figure 9:
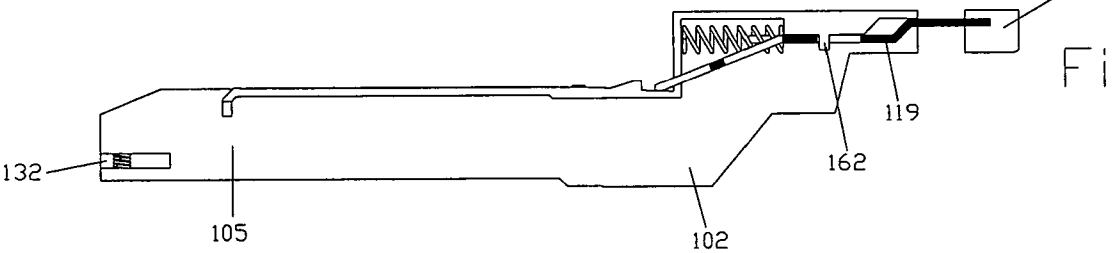
FIG. 9 is is a side elevation cut-away view taken at line 8-8 from FIG. 1 depicting the push button in a second position.

The module 100 includes an enlarged end 160 (FIG. 1) having a lever mating area 161 including a finger 162 disposed within the opening 157, a resilient member 114 (e.g spring or rubber bushing) for receiving the tab 158 thereon and a pair of legs 155*a,b* of the "H" shaped segment 152 for sliding and engaging a release tab 159. So as depicted in FIGS. 8-9, a body 119 may be moved between a latched and unlatched condition (FIG. 9). By pressing on button 113 in direction of arrow A (FIG. 8). A user that applies sufficient counterforce to the resilient member 114, can move the first segment 151 against the release tab 159 to push the module housing backward in order to release the module 100 from the cage of the host device. As shown in FIG. 9, the resilient member 114 will then return the body 119 to the latched condition. The opening 157 is formed having a corresponding length to the distance required to move the module housing to the delatched condition. The finger 162 abuts the first end of the opening 157 when the body is the latched condition (FIG. 8) and abuts the second end of the opening when the body is in the unlatched condition (FIG. 9).

Figure 10:
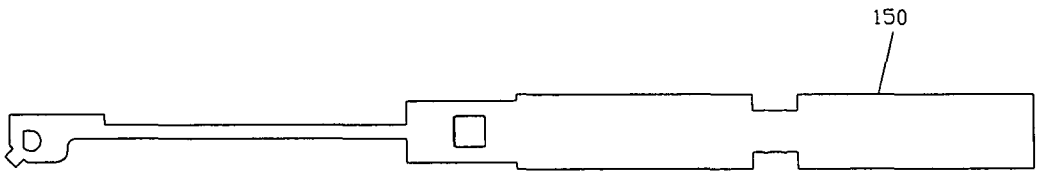
FIG. 10 is a plan view of a release lever sheet prior to final forming.
Figure 11:
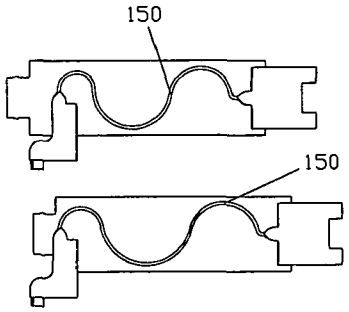
FIG. 11 is a bottom view of the forming process of the release lever sheet of the present invention.
Figure 12:
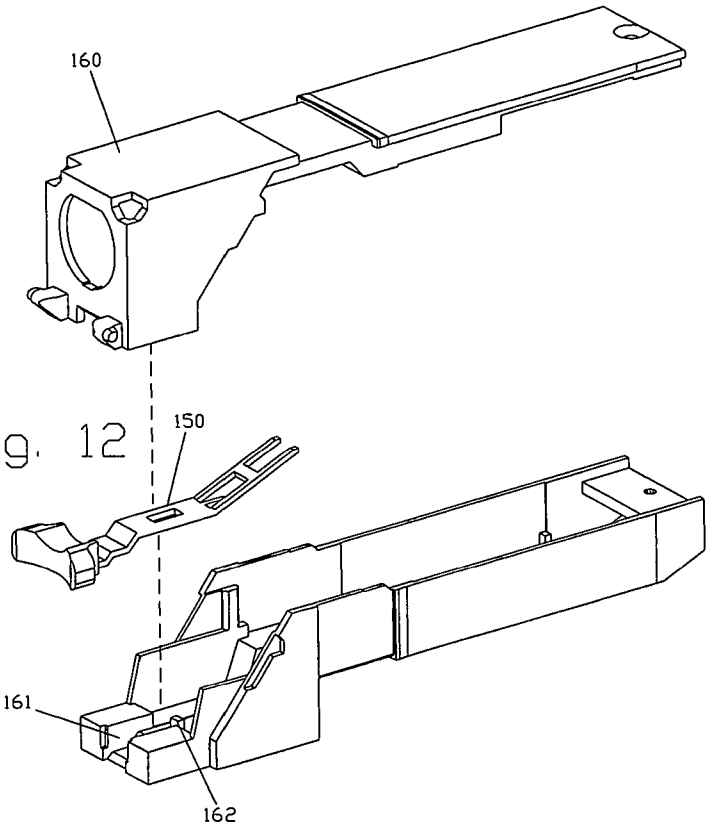
FIG. 12 is side elevation exploded view of the module of FIG. 1.
Figure 13A:
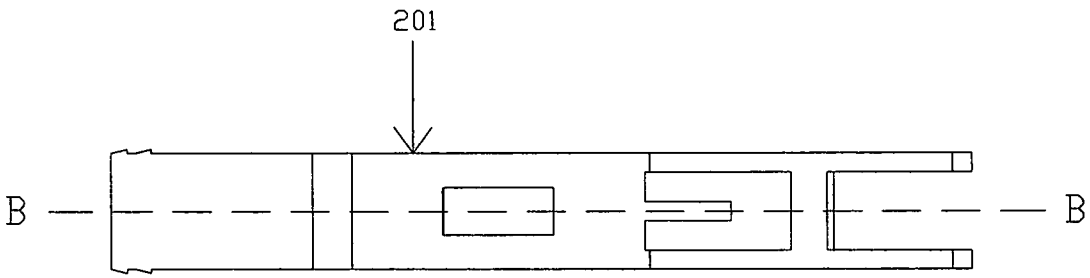
FIG. 13*a* is a plan view of the release lever sheet in a flattened state prior to forming.
Figure 13B:
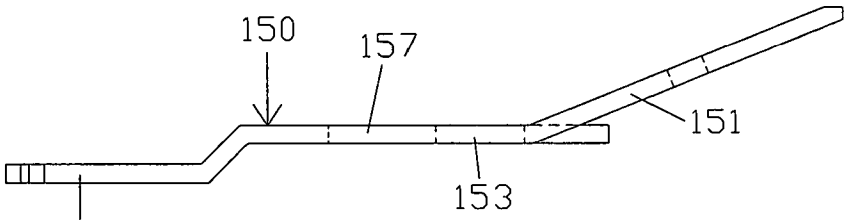
FIG. 13*b* is a side elevation view of the sheet of FIG. 13*a*, after forming.
Figure 13C:
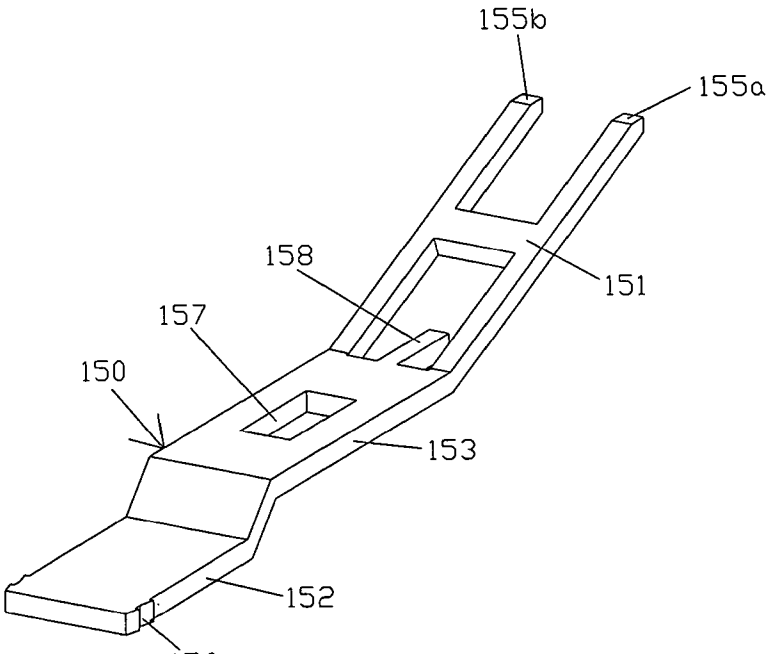
FIG. 13*c* is a perspective view of the release lever of FIG. 13*b;*

FIG. 10-11 depicts how the body 119 of the release lever 150 is manufactured. The body is stamped from a flat metal sheet as shown in FIG. 10. In FIG. 11 a machine is depicted for rolling and bending the body 119 in order to form the release lever 150 depicted in FIG. 13*c*.

Also, returning to FIG. 2 a flange 116 which serves as the means for aligning an F-type connector 118 to the main printed circuit board 130. Furthermore, in addition to accomplishing proper mechanical alignment relative to PCB 130, the mounting flange 116 includes the resilient clip 126 which is soldered to the PCB 130 to accomplish an electric connection to ground (GND).

In an embodiment, the module 100 of the present invention may be assembled as follows: a balun is obtained having a ferrite core having high magnetic permeability, having the overmolding removed and having surface mount leads (instead of through hole leads);

mounting the balun to a first side of a printed circuit board (PCB) via a surface mount process; mounting other components to a second side of the PCB, casting a housing from an alloy such as zinc alloy or aluminum alloy, stamping a release lever from a flat sheet of metal so that the lever 150 is symmetrical about a centerline of the body of the lever, the centerline B-B (FIG. 13*a*) bisecting the length of the lever 150; forming the release lever by bending the flat metal to form a first, second and third segment of the release lever and inserting the lever within a mating area of the lower housing half 102. The assembly further comprising capturing the PCB 130 and coaxial connector assembly within the upper and lower housing halves 101, 102 and the assembly including the flange 116 having the resilient clip 126, for mounting to the PCB and grounding the resilient clip 126 and F-type connector assembly 118. Finally, the EMI collar 122 is snapped onto the recess 129 of the housing 112.

With respect to FIGS. 1-15, the following components are provided as shown in the figures:

100—module
101—housing upper half
102 housing lower half
105—first housing end
111—housing top
112—housing bottom
113—Disengager button
114—Elastic member
115—Front body housing
116—Flange
117—Nut
118—F-Type coaxial connector assembly
119—release lever
120—Pivoting latch lever
121—Arm for pivoting latch lever
122—EMI collar
123—Axle for pivoting latch lever
124—fastener
125—Base connecting bar for latch lever
126—clip
127—Release latch
129—PCB support
130—printed circuit board
132—Edge connector to mate with host connector
150—lever body
160 enlarged end
201—input via F-type connector
202—GDT
203—SPD
204 LPF
205—surface mount contact
206—balun
207 AFE
208—DSP PHY
209—SFP 20 pin connector output
210—FLASH memory
211—Serial ID EEPROM
212—Power supply The above description discloses only certain preferred embodiments of the invention, yet the full scope of the invention is much broader and should be bound only by the claims as issued in a utility patent.

What is claimed:

1. A pluggable module comprising:

a housing having a first end and an opposite second end, an edge connector disposed at the first end, an F-type coaxial connector at the second end, the F-type coaxial connector electrically connected to the edge connector, the edge connector for pluggably mating the first end of the housing within a host receptable; and a miniature balun disposed within the module and electrically connected between the F-type coaxial connector and the edge connector, the miniature balun for converting between a single-ended input to a differential load of signal processing component.

2. The pluggable module of claim 1 wherein the first end and the edge connector are compliant with Small Form Factor Pluggable (SFP) specifications.

3. The pluggable module of claim 1 wherein the balun omits at least one of the following elements: a) thru-hole leads; b) over-molding; and c) ferrite core of low magnetic permeability.

4. The pluggable module of claim 1 wherein the balun provides at least one of the following elements: a) surface mount leads; b) ferrite core of high magnetic permeability; c) an overall height of the balun package being restricted for use within the envelope dimensions provided by SFP specification.

5. The pluggable module of claim 1 wherein the module is miniaturized by providing a printed circuit board (PCB) having components on both sides of the PCB and the balun having surface mount leads for mounting to pads on a first side of the PCB and facilitating mounting of other components on a second side of the PCB.

6. The pluggable module of claim 1 comprising a release lever including a stamped body that is symmetrical about and parallel to a centerline bisecting the length of the body, and the release lever attached to the housing for releasing the first end and the edge connector from the host receptacle.

7. The pluggable module of claim 6 wherein the body is stamped from a flat metallic sheet.

8. The pluggable module of claim 6 wherein the body includes three segments, the first segment forming a generally "H" shaped member, an opposite second segment having side serrations for receiving a button thereon and a third segment disposed between the first and second segments, the third segment having an opening and a tab extending into a bottom portion of the "H" shaped member.

9. The pluggable module of claim 8 comprising a module enlarged end having a lever mating area including a finger extending from the housing and disposed within the opening; a resilient member disposed between the housing and the body and for receiving the tab thereon and a pair of legs of the "H" shaped member for sliding and engaging a release tab.

10. The pluggable module of claim 1 wherein the housing is cast from one of aluminum aluminum alloy, zinc and zinc alloy.

11. The pluggable module of claim 1 further comprising a Gfast wireline physical layer in electrical connection to the edge connector for improving broadband performance.

12. The pluggable module of claim 1 further comprising a G.hn wireline physical layer in electrical connection to the edge connector for improving broadband performance.

13. The pluggable module of claim 1 further comprising a VDSL/VDSL2 wireline physical layer in electrical connection to the edge connector for improving broadband performance.

14. A pluggable module comprising:

a housing having a first end and an opposite second end, an edge connector disposed at the first end for pluggably connecting to a host, an F-type coaxial connector at the second end, the F-type coaxial connector electrically connected to the edge connector; and a release lever including a stamped body that is symmetrical about and parallel to a centerline bisecting the length of the body, the release lever attached to the housing for releasing the first end and the edge connector from the host.

15. The pluggable module of claim 14 wherein the body is stamped from a flat metallic sheet.

16. The pluggable module of claim 14 wherein the body includes three segments, the first segment forming a generally "H" shaped release member, an opposite second segment having side serrations for receiving a button thereon and a third segment disposed between the first and second segments, the third segment having an opening and a tab extending into a bottom portion of the "H" shaped release member.

17. The pluggable module of claim 16 comprising a module enlarged end having a lever mating area including a finger disposed within the opening; a resilient member for receiving the tab thereon and a pair of legs of the "H" shaped release member for sliding and engaging a release tab.

18. The pluggable module of claim 14 further comprising a miniature balun disposed within the module and electrically connected between the F-type coaxial connector and the edge connector for converting between a single-ended input to a differential load.

19. A method of assembling a pluggable module comprising the steps of:

obtaining a balun having a ferrite core having high magnetic permeability;

mounting the balun to a first side of a printed circuit board (PCB) via a surface mount process;

mounting other components to a second side of the PCB the PCB electrically connecting components mounted thereon;

casting a housing from an alloy;

stamping a release lever from a flat sheet of metal;

forming the release lever by bending the flat metal to form a first, second and third segment of the release lever;

mounting a the balun on a first side of a two sided PCB, the balun having no over-molded lid and a reduced profile and the balun mounted using surface mount tails to provide a low profile mounting orientation and mounting the PCB to a flange that supports an F-type connector, the flange having a clip for soldering attaching to a pad on the PCB.

20. The method of claim 19 wherein the body of the release lever is formed to provide, the first segment forming a generally "H" shaped release member, an opposite second segment having side serrations for receiving a button thereon and the third segment disposed between the first and second segments, the third segment having an opening capable of receiving a tab extending into a bottom portion of the "H" shaped release member, the release lever attached to the housing for releasing the first end and the edge connector from a host.

21. The method of claim 19 further comprising the steps of mounting the balun on a first side of a two sided PCB, the balun having no over-molded lid and a reduced profile and the balun mounted using surface mount tails to provide a low profile mounting orientation and mounting the PCB to a flange that supports an F-type connector, the flange having a clip for attaching to a pad on the PCB.

* * * * *